US005320045A

United States Patent [19]

Theurer

[11] Patent Number: 5,320,045

[45] Date of Patent: Jun. 14, 1994

[54] MACHINE FOR DELIVERING BALLAST TO A TRACK AND FOR TAMPING THE BALLAST HAVING PIVOTAL BALLAST DISTRIBUTING CONVEYORS AND SWEEPER BROOM BALLAST TAKE-UP

[75] Inventor: Josef Theurer, Vienna, Austria

[73] Assignee: Franz Plasser Bahnbaumaschinen-Industriegesellschaft m.b.H, Vienna, Austria

[21] Appl. No.: 11,953

[22] Filed: Feb. 1, 1993

[30] Foreign Application Priority Data

Feb. 21, 1992 [AT] Austria ..... 329/92

[51] Int. Cl.[5] ..... E01B 27/02; E01B 27/04

[52] U.S. Cl. ..... 104/2; 105/247; 37/104

[58] Field of Search ..... 104/2, 12; 105/247; 37/104; 171/16

[56] References Cited

U.S. PATENT DOCUMENTS

| | | | |
|---|---|---|---|
| 4,152,989 | 5/1979 | Theurer et al. | 104/2 |
| 4,178,995 | 12/1979 | Theurer et al. | 104/2 X |
| 4,257,331 | 3/1981 | Theurer et al. | 104/2 |
| 4,263,851 | 4/1981 | Theurer et al. | 104/2 X |
| 4,770,104 | 9/1988 | Theurer | 104/7.2 |
| 4,809,617 | 3/1989 | Theurer et al. | 104/2 X |
| 4,881,467 | 11/1989 | Theurer et al. | 104/12 X |
| 5,094,018 | 3/1992 | Theurer et al. | 104/2 X |
| 5,101,733 | 4/1992 | Mohr | 104/12 |
| 5,172,636 | 12/1992 | Theurer et al. | 104/2 |

*Primary Examiner*—Douglas C. Butler
*Assistant Examiner*—S. Joseph Morano
*Attorney, Agent, or Firm*—Collard & Roe

[57] ABSTRACT

An installation for distributing ballast in a track bed supporting a track and for tamping the ballast comprises a machine frame comprised of a first machine frame part and a second machine frame part, the first machine frame part preceding the second machine frame part in the operating direction. The machine frame is supported by undercarriages on the track for movement in an operating direction. Mounted on the first machine frame part are a ballast tamping unit and a track lifting and lining unit, and mounted on the second machine frame part are a ballast storage bin having outlets for delivering ballast from the bin to the track, a ballast conveyor having an output end above the ballast storage bin and an input end, and a vertically adjustable broom arrangement for sweeping excess ballast from the track to the ballast conveyor input end.

6 Claims, 2 Drawing Sheets

MACHINE FOR DELIVERING BALLAST TO A TRACK AND FOR TAMPING THE BALLAST HAVING PIVOTAL BALLAST DISTRIBUTING CONVEYORS AND SWEEPER BROOM BALLAST TAKE-UP

BACKGROUND OF THE INVENTION

1. Field of the Invention

The present invention relates to a machine for delivering ballast to a track and for tamping the ballast, which comprises a machine frame supported on the track by undercarriages for movement in an operating direction and mounted on the machine frame a ballast tamping unit, a track lifting and lining unit, a ballast storage bin having outlet means for delivering ballast from the bin to the track, a ballast conveyor means having an output end above the ballast storage bin and an input end, and a vertically adjustable broom arrangement for sweeping excess ballast from the track to the ballast conveyor means input end.

2. Description of the Prior Art

A machine of this general type has been disclosed in U.S. Pat. No. 4,770,104, this machine being comprised of a ballast cleaning machine preceding a ballast tamping machine. The machine frame of the ballast tamping machine carries a ballast tamping unit and a ballast lifting and lining unit which is preceded, in the operating direction, by a ballast storage bin having outlet means for delivering ballast to the track and receiving cleaned ballast from an output end of a ballast conveyor means arranged above the bin. A vertically adjustable broom arrangement sweeps excess ballast to the lower input end of the ballast conveyor means. Since the ballast is discharged through the outlet means of the ballast storage bin while the ballast tamping machine advances continuously, it is relatively difficult to limit the discharge of the ballast into the cribs of the track.

U.S. Pat. No. 4,257,331 discloses a machine for cleaning the ballast and then to compact the cleaned ballast. This machine comprises a ballast cleaning machine preceding a ballast compacting machine coupled to the ballast cleaning machine. A ballast storage bin having outlet means for delivering the cleaned ballast to the track is positioned at the front end of the ballast compacting machine, and a ballast conveyor band conveys the cleaned ballast from the ballast cleaning machine to the bin. A vertically adjustable broom arrangement is mounted rearwardly of the ballast compacting unit. This machine serves for compacting the cleaned ballast immediately after it has been delivered to the track.

SUMMARY OF THE INVENTION

It is the primary object of this invention to improve a machine of the first-described type by providing a better ballast distribution for the ballast tamping operation.

The above and other objects are accomplished according to the invention with a machine for delivering ballast to a track comprising rails and for tamping the ballast, which comprises a machine frame comprised of a first machine frame part and a second machine frame part, and undercarriages supporting the machine frame on the track for movement in an operating direction, the first machine frame part preceding the second machine frame part in the operating direction. Mounted on the first machine frame part are a ballast tamping unit and a track lifting and lining unit, and mounted on the second machine frame part are a ballast storage bin having outlet means for delivering ballast from the bin to the track, a ballast conveyor means having an output end above the ballast storage bin and an input end, and a vertically adjustable broom arrangement for sweeping excess ballast from the track to the ballast conveyor means input end.

This arrangement is very advantageous because the second machine frame part with the ballast storage bin, the broom arrangement and the ballast conveyor means can be constructed independently of the first machine frame part with the tamping and track correction units, and this second machine frame part may simply be coupled to a ballast tamping, leveling and lining machine in use, which then constitutes the first machine frame part, and may be detached therefrom. This arrangement of the ballast storage bin leaves the basic structural concept of the ballast tamping and track correction units in place so that an optimal and efficient tamping is in no way influenced thereby. The ballast may be delivered to the track selectively before or after the tamping so that this operation will not affect the view of the tamping site by the operator since, in the first case, the broom arrangement will sweep excess ballast off the ties into the adjacent cribs while, in the second case, no excess ballast lies on the ties. In either case, the improved ballast distribution will provide a very uniform and clean track after tamping.

Preferably, the ballast storage bin outlet means comprises at least one ballast outlet which is transversely displaceable relative to the track, i.e. a plurality of outlets spaced transversely from each other relative to the track, at least one of the outlets being displaceable in a direction extending perpendicularly to the track. This is useful particularly when the machine is used in a switch since the transversely displaceable outlets make it possible to deliver the ballast to the intersections of the branch rail with the ties, where the track is supported on the ballast and where it is desirable to distribute additional ballast. In view of the asymmetrical arrangement of track switches, this uniform distribution of the ballast is of particular importance and assures long-lasting tamping.

According to another preferred feature of the present invention, the ballast storage bin outlet means comprises a respective horizontally extending ballast conveyor band having an input end arranged immediately under a respective outlet opening and an outlet end spaced therefrom, the ballast conveyor band being pivotal about a vertical axis, and a drive for pivoting the ballast conveyor band about the vertical axis. This provides a simple structure assuring a targeted discharge of the ballast and an automatic closure of the outlet opening when the ballast conveyor band is stopped.

If the ballast storage bin outlet means comprises at least four outlet openings spaced transversely from each other relative to the track and a cylindrical or funnel-shaped ballast distributing chute associated with each outlet opening, at least two of the chutes being mounted on the bin for pivoting about an axis extending parallel to the track, and a respective drive for pivoting each pivotal chute, the ballast distribution may be readily adapted to the position of the rails in a switch so that a proper ballast distribution over the entire width of the switch is assured in a single operating pass. Preferably, the machine further comprises a sensing device on each one of the pivotal chutes for detecting the position of a respective one of the track rails, the sensing device emitting a control signal upon detecting the track rail position for actuating the respective pivoting drive. This assures an automatic transverse adjustment of the pivotal chutes to follow the diverging track rail in the switch.

Where the broom arrangement is positioned rearwardly of the ballast storage bin outlet means in the operating direction, the machine may be used to clean the track in a second pass after it has been tamped in a first pass.

A driven, horizontal ballast conveyor band extending perpendicularly to the track between the broom arrangement and the ballast conveyor means input end may be provided so that excess ballast may be conveyed to the track shoulder if the bin is full.

Furthermore, wherein the second machine frame part may have an upwardly recessed portion and the broom arrangement is vertically adjustably mounted in the recessed machine frame portion, which makes it possible to use a large broom arrangement which can be readily adjusted vertically.

The undercarriages supporting the machine frame on the track comprise a front undercarriage and a rear undercarriage supporting the second machine frame part, and accurate centering of the storage bin outlet means and the broom arrangement are assured in track curves if the ballast storage bin outlet means is arranged near the front undercarriage and the broom arrangement is arranged near the rear undercarriage.

BRIEF DESCRIPTION OF THE DRAWING

The above and other objects, advantages and features of the invention will be described hereinafter in connection with certain now preferred embodiments thereof, taken in conjunction with the somewhat schematic drawing wherein.

DETAILED DESCRIPTION OF THE PREFERRED EMBODIMENTS

Figure 1:
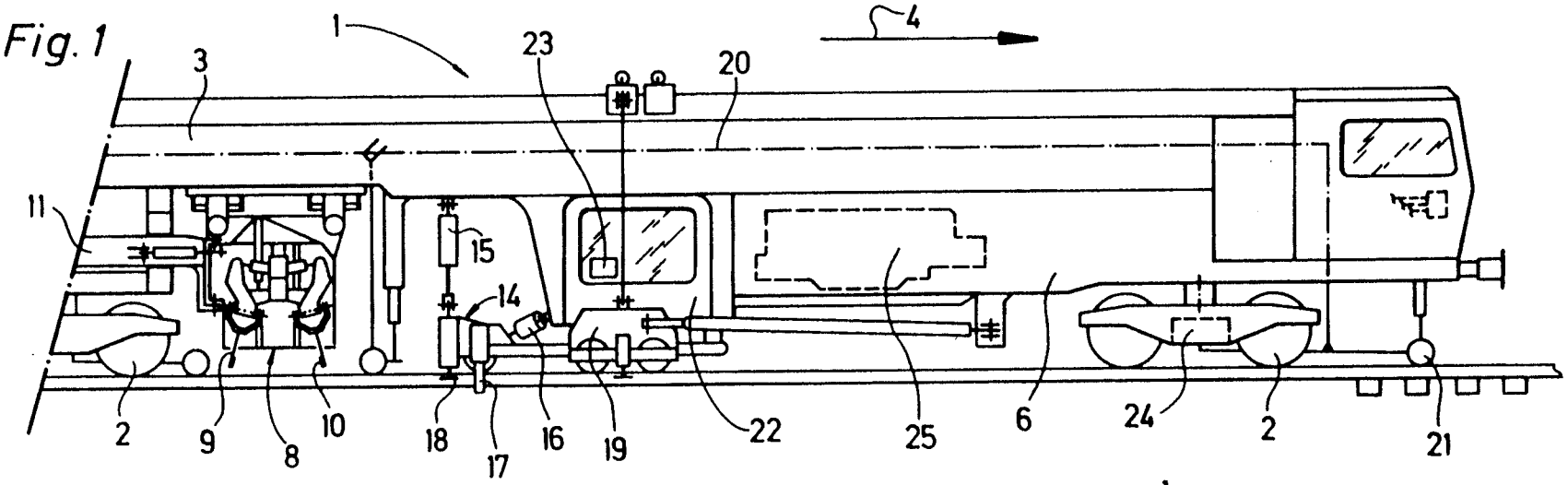
FIGS. 1 and 2 show a machine for delivering ballast to a track and tamping the ballast in side elevation.
Figure 2:
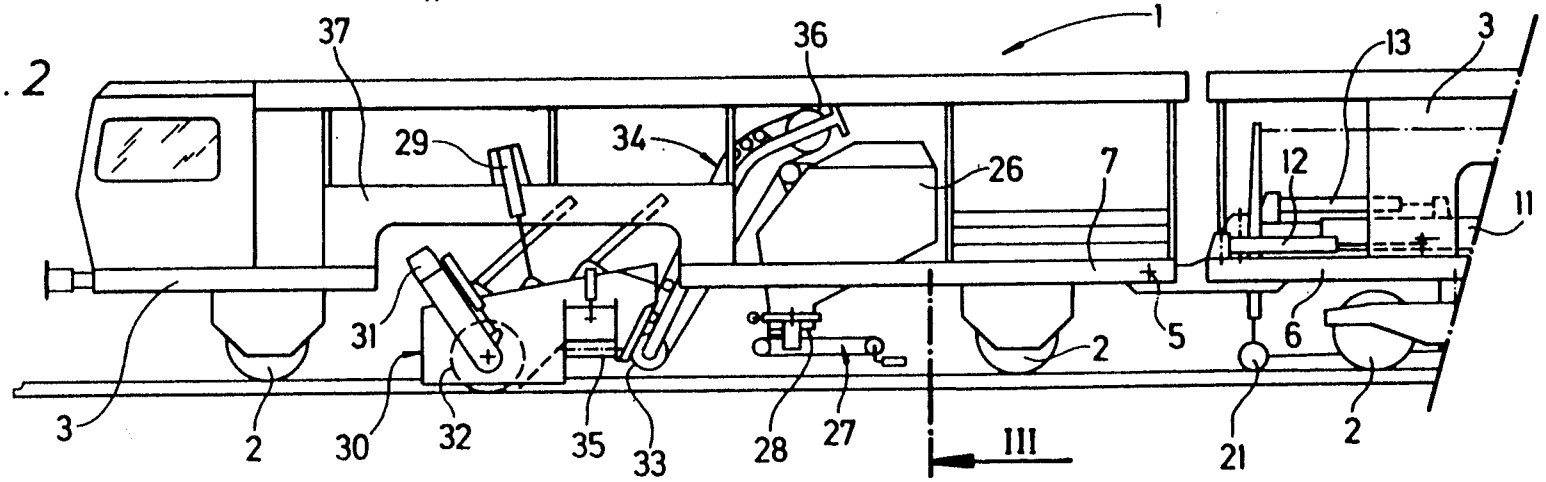

Referring now to the drawing and first to FIGS. 1 and 2, machine 1 for delivering ballast to a track and for tamping the ballast comprises machine frame 3 comprised of first machine frame part 6 and second machine frame part 7 coupled together at 5. Undercarriages 2 support machine frame 3 on the track for movement in an operating direction indicated by arrow 4, first machine frame part 6 preceding second machine frame part 7 in the operating direction.

Mounted on first machine frame part 6 are four independently transversely displaceable ballast tamping units 8 for operating in a track switch (only one unit being shown in the side elevation of FIG. 1 and hiding the three units aligned therebehind) and track lifting and lining unit 14. Each ballast tamping unit 8 comprises pairs of reciprocable and vibratory tamping tools 9 whose tamping picks 10 are immersible in the ballast for tamping the ballast under the track ties upon reciprocation and vibration of the tamping tools and which may be pivoted about axes extending parallel to the track for selective operation in track switches. The two ballast tamping units nearest the respective track shoulders, i.e. the outer ballast tamping units, are connected to carriers 11 which are pivotally mounted on machine frame part 6. They may be pivoted about vertical axes by pivoting drive 12 and may be longitudinally displaced by drives 13. Track lifting and lining unit 14 precedes ballast tamping units 8 in the operating direction and comprises drives 15, 15 linked to machine frame part 6 for vertically and laterally adjusting the unit for correcting the level of, and/or aligning, the track engaged by lifting hooks 17 and lifting rollers 18 subtending the rail heads. An auxiliary lifting device 19 enables a branch rail to be engaged in a track switch and the track correction is controlled by a reference system 20 extending between measuring axles 21. The track correction and tamping operations are viewed and controlled by an operator in operator's cab 22 which houses central control panel 23. A power source 25 for the various operating drives, including drive 24 for advancing the machine, is also mounted on machine frame part 6. All of these structures are entirely conventional in switch tampers and are, therefore, not described in further detail.

Mounted on second machine frame part 7 are ballast storage bin 26 having outlet means 28 for delivering ballast from the bin to the track, inclined ballast conveyor means 34 having upper output end 36 above ballast storage bin 26 and lower input end 33, and vertically adjustable broom arrangement 30 for sweeping excess ballast from the track to ballast conveyor means input end 33. The ballast broom arrangement is linked to machine frame part 7 by vertical adjustment drive 29 and comprises broom 32 extending transversely to the track and rotatable by drive 31 about a horizontally extending axis. The machine further comprises driven, horizontal ballast conveyor band 35 extending perpendicularly to the track between broom arrangement 30 and ballast conveyor means input end 33. Second machine frame part 7 has upwardly recessed portion 37 and broom arrangement 30 is vertically adjustably mounted in recessed machine frame portion 37.

As shown in the drawing, broom arrangement 30 is positioned rearwardly of ballast storage bin outlet means 27, 28 in the operating direction. Undercarriages 2 supporting machine frame 3 on the track comprise a front undercarriage and a rear undercarriage supporting second machine frame part 7, ballast storage bin outlet means 28 being arranged near the front undercarriage and broom arrangement 30 being arranged near the rear undercarriage.

Figure 3:
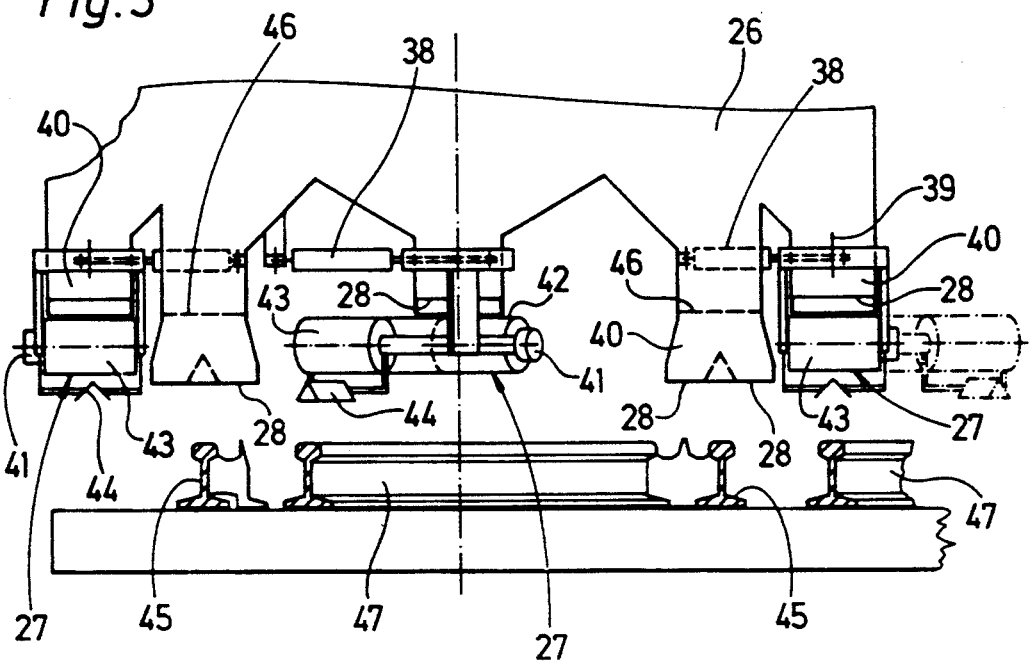
FIG. 3 is an enlarged cross section taken in the direction of arrow III of FIG. 2, showing one embodiment of the ballast storage bin outlet means.
Figure 4:
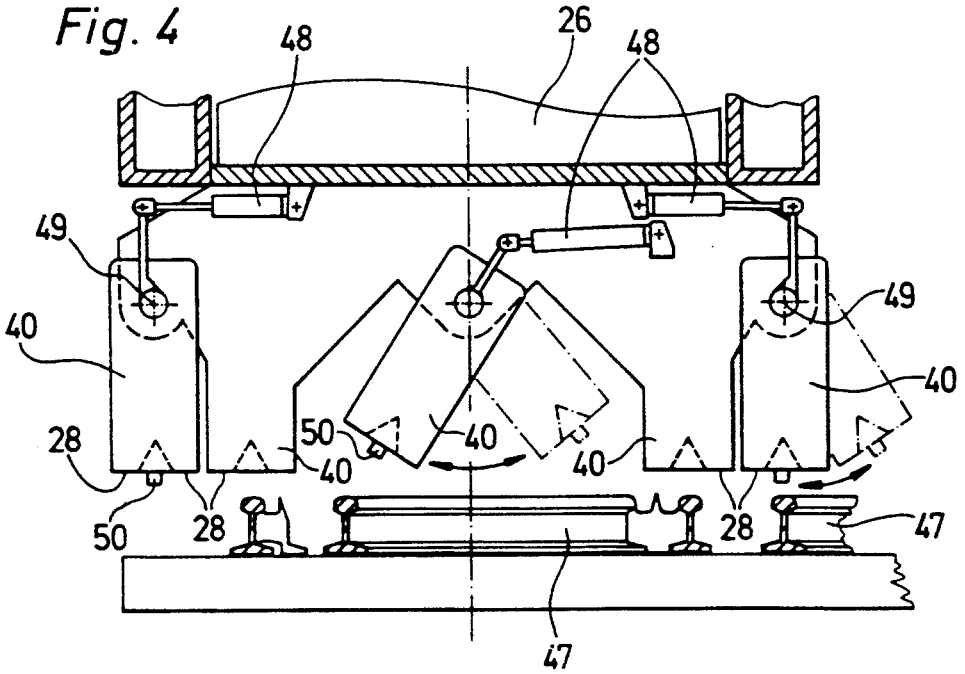
FIG. 4 is a similar view showing another embodiment of the outlet means.

As can be seen in FIGS. 3 and 4, ballast storage bin outlet means 28 comprises at least one ballast outlet which is transversely displaceable relative to the track. The illustrated ballast storage bin outlet means comprises a plurality of outlets 28 spaced transversely from each other relative to the track, at least one of the outlets being displaceable in a direction extending perpendicularly to the track. A respective horizontally extending ballast conveyor band 27 is associated with each outermost outlet 28 and central outlet 28, each conveyor band having input end 42 equipped with rotary drive 41 and arranged immediately under a respective outlet opening and outlet end 43 spaced therefrom. A ballast dividing device 44 is provided at each outlet end of ballast conveyor band 27 to prevent the ballast from being discharged on a subtending rail (branch rail 47 in FIG. 3). Each ballast conveyor band 27 is pivotal about vertical axis 39, and drive 38 pivots the ballast conveyor band about the vertical axis. Two fixed ballast discharge chutes 40 are provided for delivering ballast to the intersections of main track rails 45 and the ties, and remote-controlled closures 46 enable outlet openings 28 of these chutes to be selectively closed.

When machine 1 operates in a track switch, the three ballast distributing conveyor bands 27 are oriented substantially parallel to the main track and rotary drives 41 are not actuated so that the conveyor bands serve as closures for outlet openings 28 whereunder they are arranged. On the other hand, remote-controlled closures 46 in fixed ballast discharge chutes 40 aligned with main track rails 45 are selectively opened to distribute ballast to any intersections of rails 45 and the ties, i.e. the points where the track is supported on the ballast, where there are indications that there is insufficient ballast. As soon as the continuously advancing installation reaches branch track rails 47 in the switch, pivoting drives 38 of the two ballast conveyor bands 27 aligned with rails 47 are actuated to pivot these conveyor bands until their outlet ends 43 are centered above these rails. Rotary drives 43 are then operated to convey the ballast coming from bin 26 from outlet openings 28 to conveyor band outlet ends 43 where dividing device 44 above each rail distributes the ballast to both sides of rails 47.

Installation 1 may be operated in the following manner to distribute ballast in the track bed, in conjunction with tamping the ballast:

(1) The ballast distribution may be effected in a first operating stage while the installation is advanced along a track section and the installation is subsequently advanced in a second operating stage along this track section to tamp the ballast. Broom arrangement 30 may be used in the second stage for a final cleaning of the track after tamping.

(2) Ballast distribution and tamping may be effected in a single operating stage, i.e. the track is tamped and additional ballast is then selectively distributed in the track bed. This method is useful only in track sections which require relatively small amounts of additional ballast.

Broom arrangement 30 assures that any excess ballast generated during the operation of installation 1 is directed to ballast conveyor 34 and is conveyed thereby into storage bin 26. If the ballast storage bin is full, any additional excess ballast may be conveyed to the track shoulders by transverse conveyor band 35.

FIG. 4 illustrates another embodiment of the ballast storage bin outlet means, like reference numerals indicating like parts functioning in a like manner. This outlet means also comprises five outlet openings 28 spaced transversely from each other relative to the track and a cylindrical or funnel-shaped ballast distributing chute 40 is associated with each outlet opening. Three of the chutes are mounted on ballast storage bin 26 for pivoting about axis 49 extending parallel to the track, and a respective drive 48 is connected to each pivotal chute 40 for pivoting the same. A sensing device 50, such as an inductive signal transmitter, on each pivotal chute 40 detects the position of a respective branch track rail 47 and emits a control signal upon detecting the track rail position for actuating respective pivoting drive 48. In this way, outlet opening 28 of each pivotal chute automatically follows each rail 47 and is able selectively to distribute ballast along the rail when a closure in the chute (not shown in FIG. 4 but similar to closure 46 in FIG. 3) is opened. As indicated by broken lines, each outlet opening 28 is divided into two discharge channels operating in the same manner as ballast dividing device 44 so that the distributed ballast falls on both sides of the rails rather than on the rails themselves.

What is claimed is:

1. An installation for distributing ballast in a track bed supporting a track comprising rails and for tamping the ballast, which comprises (a) a machine frame comprised of
  (1) a first machine frame part and
  (2) a second machine frame part,
(b) undercarriages supporting the machine frame on the track for movement in an operating direction,
  (1) the first machine frame part preceding the second machine frame part in the operating direction,
(c) mounted on the first machine frame part
  (1) a ballast tamping unit and
  (2) a track lifting and lining unit, and
(d) mounted on the second machine frame part
  (1) a ballast storage bin having outlet means for delivering ballast from the bin to the track, the ballast storage bin outlet means comprising a respective horizontally extending ballast conveyor band having an input end arranged immediately under a respective outlet opening and an outlet end spaced therefrom, the ballast conveyor band being pivotal about a vertical axis whereby the outlet end is transversely displaceable relative to the track, and a drive for pivoting the ballast conveyor band about the vertical axis,
  (2) a ballast conveyor means having an output end above the ballast storage bin and an input end, and
  (3) a vertically adjustable broom arrangement for sweeping excess ballast from the track to the ballast conveyor means input end.

2. The installation of claim 1, wherein the ballast storage bin outlet means comprises a plurality of outlet openings spaced transversely from each other relative to the track, at least one of the outlet openings having the pivotal ballast conveyor band arranged immediately thereunder.

3. The installation of claim 1, wherein the broom arrangement is positioned rearwardly of the ballast storage bin outlet means in the operating direction.

4. The installation of claim 1, further comprising a driven, horizontal ballast conveyor band extending perpendicularly to the track between the broom arrangement and the ballast conveyor means input end.

5. The installation of claim 1, wherein the second machine frame part has an upwardly recessed portion and the broom arrangement is vertically adjustably mounted in the recessed machine frame portion.

6. The installation of claim 1, wherein the undercarriages supporting the machine frame on the track comprise a front undercarriage and a rear undercarriage supporting the second machine frame part, the ballast storage bin outlet means being arranged near the front undercarriage and the broom arrangement being arranged near the rear undercarriage.

* * * * *